US008449764B2

(12) United States Patent
Chakrabarty et al.

(10) Patent No.: US 8,449,764 B2
(45) Date of Patent: May 28, 2013

(54) METHOD FOR USING NATIVE BITUMEN MARKERS TO IMPROVE SOLVENT-ASSISTED BITUMEN EXTRACTION

(75) Inventors: Tapantosh Chakrabarty, Calgary (CA); Ken N. Sury, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 726 days.

(21) Appl. No.: 12/606,031

(22) Filed: Oct. 26, 2009

(65) Prior Publication Data

US 2010/0126911 A1 May 27, 2010

(30) Foreign Application Priority Data

Nov. 26, 2008 (CA) ..... 2644821

(51) Int. Cl.
*C10G 21/30* (2006.01)
*C10G 21/14* (2006.01)
*C10G 1/04* (2006.01)

(52) U.S. Cl.
USPC ..... 208/337; 208/311; 208/322; 208/390; 250/307; 378/47

(58) Field of Classification Search
USPC .. 208/390, 311, 322, 323, 337, 339; 250/307; 378/47
See application file for complete search history.

(56) References Cited

U.S. PATENT DOCUMENTS 4,280,559 A 7/1981 Best
4,344,485 A 8/1982 Butler
4,676,889 A 6/1987 Hsieh et al.
4,743,357 A * 5/1988 Patel et al. ..... 208/113
4,830,997 A * 5/1989 Trinh et al. ..... 502/28
5,236,577 A 8/1993 Tipman et al.
5,876,592 A 3/1999 Tipman et al.
5,899,274 A 5/1999 Frauenfeld et al.
5,968,349 A 10/1999 Duyvesteyn et al.
6,007,709 A 12/1999 Duyvesteyn et al.
6,214,213 B1 4/2001 Tipman et al.
6,708,759 B2 3/2004 Leaute et al.
6,769,486 B2 8/2004 Lim et al.
7,067,811 B2 * 6/2006 Long et al. ..... 250/339.12
7,141,162 B2 11/2006 Garner et al.

(Continued)

FOREIGN PATENT DOCUMENTS

CA 1246993 A 12/1988
CA 2075108 * 1/1994

(Continued)

OTHER PUBLICATIONS

Bichard, J.A., "*Oil Sands Composition and Behaviour Research*," AOSTRA, 1987.

(Continued)

*Primary Examiner* — Prem C Singh
*Assistant Examiner* — Renee E Robinson
(74) *Attorney, Agent, or Firm* — ExxonMobil Upstream Research Company Law Department

(57) ABSTRACT

In solvent-assisted bitumen extraction, a native marker, for example: sulfur, nickel, vanadium, iron copper, or manganese, is used to control the solvent to bitumen ratio in a process stream such as a stream from a froth separation unit (FSU) and/or to measure hydrocarbon loss in a tailings solvent recovery unit (TSRU).

8 Claims, 2 Drawing Sheets

U.S. PATENT DOCUMENTS

| | | | | |
|---|---|---|---|---|
| 7,244,350 | B2 * | 7/2007 | Martin et al. | 208/209 |
| 7,261,810 | B2 | 8/2007 | Argo et al. | |
| 7,282,136 | B2 | 10/2007 | Howdeshell | |
| 2003/0062163 | A1 * | 4/2003 | Moulton et al. | 166/302 |
| 2006/0113218 | A1 | 6/2006 | Hart et al. | |
| 2006/0138055 | A1 | 6/2006 | Garner et al. | |
| 2006/0260980 | A1 | 11/2006 | Yeung | |

FOREIGN PATENT DOCUMENTS

| | | | |
|---|---|---|---|
| CA | 2200899 | A1 | 9/1998 |
| CA | 2567399 | A1 | 10/1999 |
| CA | 2633061 | A1 | 8/2001 |
| CA | 2374115 | A1 | 9/2003 |
| CA | 2232929 | C | 5/2004 |
| CA | 2425840 | A1 | 10/2004 |
| CA | 2353109 | C | 12/2005 |
| CA | 2520943 | A1 | 4/2006 |
| CA | 2235085 | C | 1/2007 |
| CA | 2521248 | A1 | 3/2007 |
| CA | 2552482 | A1 | 1/2008 |
| CA | 2299790 | C | 7/2008 |
| CA | 2351148 | C | 7/2008 |
| CA | 2587166 | C | 10/2008 |
| CA | 2613873 | C | 10/2008 |
| CA | 2614669 | C | 12/2008 |
| CA | 2592725 | C | 4/2009 |
| CA | 2595336 | C | 9/2009 |

OTHER PUBLICATIONS

Fuhr, Brian, "*Heavy Oil and Bitumen Analytical Methods: Understanding Their Capabilities and Limitations*," Canadian Crude Quality Technical Association, Alberta Research Council, Edmonton, Alberta; Oct. 28, 2009.

Crude Monitor; Home page: http://www.crudemonitor.ca/home.php and Cold Lake crude: http://www.crudemonitor.ca/crude.php?acr=CL Pages retrieved Mar. and Aug. 2012.

* cited by examiner

METHOD FOR USING NATIVE BITUMEN MARKERS TO IMPROVE SOLVENT-ASSISTED BITUMEN EXTRACTION

CROSS-REFERENCE TO RELATED APPLICATION

This application claims priority from Canadian Patent Application 2,644,821 filed Nov. 26, 2008 entitled A METHOD FOR USING NATIVE BITUMEN MARKERS TO IMPROVE SOLVENT-ASSISTED BITUMEN EXTRACTION, the entirety of which is incorporated by reference herein.

FIELD OF THE INVENTION

The present invention relates generally to solvent-assisted bitumen extraction.

BACKGROUND OF THE INVENTION

Oil sand extraction processes are used to liberate and separate bitumen from oil sand so that the bitumen can be further processed to produce synthetic crude oil. Numerous oil sand extraction processes have been developed and commercialized, many of which involve the use of water as a processing medium. Other processes are non-aqueous solvent-based processes. Solvent may be used in both aqueous and non-aqueous processes.

One water extraction process is the Clark hot water extraction process (the "Clark Process"). This process typically requires that mined oil sand be conditioned for extraction by being crushed to a desired lump size and then combined with hot (about 95° C.) water and perhaps other agents to form a conditioned slurry of water and crushed oil sand. In the Clark Process, an amount of sodium hydroxide (caustic) is added to the slurry to adjust the slurry pH upwards, which enhances the liberation and separation of bitumen from the oil sand. Other water extraction processes may use other temperatures and may include other conditioning agents, which are added to the oil sand slurry, or may not use a conditioning agent.

Regardless of the type of water extraction process employed, the process will typically result in the production of a bitumen froth that requires treatment with a solvent. For example, in the Clark Process, a bitumen froth stream comprises bitumen, fine particulate solids (also referred to as mineral matter) and water. Certain processes use naphtha to dilute bitumen froth before separating the product bitumen by centrifugation. These processes are called naphtha froth treatment (NFT) processes. Other processes use a paraffinic solvent, and are called paraffinic froth treatment (PFT) processes, to produce pipelineable bitumen with low levels of solids and water. In the PFT process, a paraffinic solvent (for example, a mixture of iso-pentane and n-pentane) is used to dilute the froth before separating the product, diluted bitumen, by gravity. A portion of the asphaltenes in the bitumen is also rejected by design in the PFT process and this rejection is used to achieve reduced solids and water levels. In both the NFT and the PFT processes, the diluted tailings—comprising water, solids and some hydrocarbon—are separated from the product diluted bitumen.

Recovery of solvent from the diluted bitumen component is required before the bitumen may be delivered to a refining facility for further processing. Recovery of the solvent from the diluted tailings component is also desirable for several reasons, since any solvent remaining in the tailings will be discarded with the tailings in a tailings pond. First, a loss of solvent becomes an unnecessary expenditure of the extraction process. Second, any solvent remaining in the tailings pond becomes an environmental issue. Third, water in a tailings pond may be recycled and any solvent remaining in this water may create explosive conditions when reheated for re-use in the various processes.

An example of a PFT process is described further to assist the reader in understanding how the process may be operated. The PFT process may consist of at least three units: Froth Separation Unit (FSU), Solvent Recovery Unit (SRU) and Tailings Solvent Recovery Unit (TSRU). Alternatively, two FSUs may be used.

With reference to FIG. 1, in the FSU unit, mixing of solvent with the feed bitumen froth (100) is carried out counter-currently in two stages with FSU-1 and FSU-2, labeled as Froth Separation Unit 1 (102) and Froth Separation Unit 2 (104). In FSU-1 (102), the froth (100) is mixed with the solvent-rich oil stream (101) from the second stage (FSU-2) (104). The temperature of FSU-1 (102) is maintained at about 70° C. and the target solvent to bitumen ratio (STBR) is about 2:1 (w/w). The overhead from FSU-1 (102) is the diluted bitumen product (105) and the bottom stream from FSU-1 (102) is the tailings (107) consisting of water, solids (inorganics), asphaltenes and some residual bitumen. The residual bitumen from this bottom stream is further extracted in FSU-2 (104) by contacting it with fresh solvent (109) in a 25 to 30:1 (w/w) STBR at about 90° C. The solvent-rich oil (overhead) (101) from FSU-2 (104) is mixed with the fresh froth feed (100) as mentioned above. The bottom stream from FSU-2 (104) is the tailings (111) consisting of solids, water, asphaltenes and residual solvent, which is to be recovered in the Tailings Solvent Recovery Unit (TSRU) (106) prior to the disposal of the tailings (113) in tailings ponds. Solvent from the diluted bitumen overhead stream (105) is recovered in the Solvent Recovery Unit (SRU) (108) and passed as solvent (117) to Solvent Storage (110). Bitumen (115) exiting the SRU (108) is also illustrated.

In the past, STBRs in certain streams have been analyzed by density measurements.

SUMMARY OF THE INVENTION

It is an object of the present invention to obviate or mitigate at least one disadvantage of previous processes.

In solvent-assisted bitumen extraction, one or more native bitumen markers (for example: sulfur, nickel, vanadium, iron, copper, manganese, or chromium) are used to measure the solvent to bitumen ratio in a process stream, for instance a stream from a froth separation unit (FSU) and/or to measure hydrocarbon loss, for instance in a tailings solvent recovery unit (TSRU).

A "native bitumen marker" is an element that is present in the bitumen and not in the solvent, or not present in the solvent above an amount that would not allow the native bitumen marker to be used for measurement as described herein. As described below, certain native markers may be present in the inorganics (minerals) of the tailings, and may be accounted for. Where the solvent does contain an amount of native bitumen marker, it may be accounted for in the calculation.

"Solvent-assisted bitumen extraction" is a process used to extract bitumen from mined oil sands using solvent. The solvent may be, but is not limited to, a paraffinic (saturated aliphatic) solvent. In another embodiment, the solvent is a naphtha (aromatic) solvent. The extraction process may be aqueous or non-aqueous.

In the FSU, the STBR may be determined from measurement of the native bitumen marker in the solvent-diluted PFT bitumen and the target ratio may be sought through a feedback loop that controls the solvent addition into the FSU. Adjustment of the bitumen froth, solvent, or both may also be effected. The feedback may be based directly on measurement of the amount of native bitumen marker and comparison with a reference value, without having to calculate the bitumen to solvent ratio during operation.

In the TSRU, hydrocarbon loss may be determined, including residual solvent, in the tailings, again by measurements of the native bitumen marker.

Where two or more native bitumen markers are used, one option is to calculate an average STBR based on the calculated ratios obtained from each marker. Alternatively, a best-fit STBR is estimated based on the least-squares principle.

One way to measure the native markers is to use X-Ray Fluorescence (XRF). Other ways include, but are not limited to, Inductively Coupled Plasma (ICP) or Atomic Absorption (AA).

Maintaining the right STBR in FSU-1 and FSU-2 is useful as a ratio lower than the target ratio will lead to poorer product quality with higher than target water and fines concentrations. A ratio higher than the target STBR will, on the other hand, lead to more asphaltenes rejection, perhaps more fouling of the vessels and reduced product yield. It is also useful to account for the hydrocarbons in the tailings of TSRU for environmental and economic reasons.

Possible advantages of methods described herein include improving the FSU performance through better control of solvent addition, and better accounting of hydrocarbon loss in the TSRU tailings to satisfy regulatory, environmental or economic issues or concerns.

In a first aspect, the present invention provides a use of a native bitumen marker for controlling a solvent to bitumen ratio of a process stream during solvent-assisted bitumen extraction. In one embodiment, X-Ray Fluorescence is used to measure an amount of native bitumen marker in the process stream. In one embodiment, Inductively Coupled Plasma (ICP) or Atomic Absorption (AA) is used to measure an amount of native bitumen marker in the process stream. In one embodiment, the native bitumen marker is sulfur, nickel, vanadium, iron, copper, manganese, or chromium. In one embodiment, the process stream is a hydrocarbon leg from a froth separation unit of the solvent-assisted bitumen extraction. In one embodiment, the solvent-assisted bitumen extraction is a paraffinic froth treatment. In one embodiment, the solvent-assisted bitumen extraction process is a naphtha froth treatment. In one embodiment, the solvent-assisted bitumen extraction process is a non-aqueous solvent extraction process. In one embodiment, an amount of bitumen, or solvent, or both, is added to the solvent-assisted bitumen extraction, if necessary, based on the determined amount of native bitumen marker as compared to a predetermined value.

In further aspect, the present invention provides a use of a native bitumen marker for determining hydrocarbon loss via a tailings stream during solvent-assisted bitumen extraction. In one embodiment, X-Ray Fluorescence is used to measure an amount of native bitumen marker in the tailings stream for conversion to hydrocarbon loss using reference data. In one embodiment, Inductively Coupled Plasma (ICP) or Atomic Absorption (AA) is used to measure an amount of native bitumen marker in the tailings stream for conversion to hydrocarbon loss using reference data. In one embodiment, the native bitumen marker is sulfur, nickel, vanadium, iron, copper, manganese, or chromium. In one embodiment, the tailings stream is from a tailings solvent recovery unit of the solvent-assisted bitumen extraction. In one embodiment, the solvent-assisted bitumen extraction is a paraffinic froth treatment. In one embodiment, the solvent-assisted bitumen extraction is a naphtha froth treatment. In one embodiment, the solvent-assisted bitumen extraction is a non-aqueous solvent extraction process.

In further aspect, the present invention provides a method of determining hydrocarbon loss during solvent-assisted bitumen extraction, comprising: measuring an amount of a native bitumen marker in a tailings stream of the solvent-assisted bitumen extraction, and converting this amount to hydrocarbon loss via the tailings stream using reference data. In one embodiment, the native bitumen marker is sulfur, nickel, vanadium, iron, copper, manganese, or chromium. In one embodiment, the tailings stream is from a tailings solvent recovery unit of the solvent-assisted bitumen extraction. In one embodiment, the solvent-assisted bitumen extraction is a paraffinic froth treatment. In one embodiment, the solvent-assisted bitumen extraction is a naphtha froth treatment. In one embodiment, the solvent-assisted bitumen extraction is a non-aqueous solvent extraction process. In one embodiment, X-Ray Fluorescence is used to measure the amount of native bitumen marker in the tailings stream for conversion to the hydrocarbon loss via the tailings stream based on reference data. In one embodiment, Inductively Coupled Plasma (ICP) or Atomic Absorption (AA) is used to measure the amount of native bitumen marker in the tailings stream for conversion to the hydrocarbon loss via the tailings stream based on reference data.

In further aspect, the present invention provides a method of controlling a bitumen to solvent ratio of a process stream during solvent-assisted bitumen extraction comprising: measuring an amount of a native bitumen marker in the process stream; comparing this amount to a predetermined native bitumen marker reference value; and adjusting an amount of bitumen froth, or solvent, or both, to the solvent-assisted bitumen extraction, if necessary, based on the measured amount of native bitumen marker as compared to the native bitumen marker reference value. In one embodiment, the measuring is effected using X-Ray Fluorescence. In one embodiment, the measuring is effected using Inductively Coupled Plasma (ICP) or Atomic Absorption (AA). In one embodiment, the native bitumen marker is sulfur, nickel, vanadium, iron, copper, manganese, or chromium. In one embodiment, the process stream is a hydrocarbon leg from a froth separation unit of the solvent-assisted bitumen extraction. In one embodiment, the solvent-assisted bitumen extraction is a paraffinic froth treatment. In one embodiment, the solvent-assisted bitumen extraction is a naphtha froth treatment. In one embodiment, the solvent-assisted bitumen extraction is a non-aqueous solvent extraction process.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

In solvent assisted-bitumen extraction, a native bitumen marker (for example: sulfur, nickel, vanadium, iron, copper, manganese, or chromium) is used to measure the STBR in a froth separation unit (FSU) and/or to measure hydrocarbon loss in the tailings from the tailings solvent recovery unit (TSRU). A feedback loop may also be used for optimization based on such measurements.

For ease of reference, use of sulfur as the native bitumen marker is described in more detail below. The STBR is related to the measured sulfur in the PFT Bitumen Solvent Blend and the known sulfur in the PFT bitumen and the known sulfur in the PFT solvent as follows:

$$STBR=[\{\text{Sulfur in } PFT \text{ Bitumen (wt \%)}-\text{Sulfur in Solvent (wt \%)}\}/\{\text{Sulfur in } PFT \text{ Bitumen Solvent Blend (wt \%)}-\text{Sulphur in } PFT \text{ solvent (wt \%)}\}]-1$$

Recognizing that the PFT bitumen will have less sulfur than the native bitumen, the target sulfur corresponding to the target solvent to bitumen ratio is established from reference values (for example: lab data or plant data).

Figure 2:
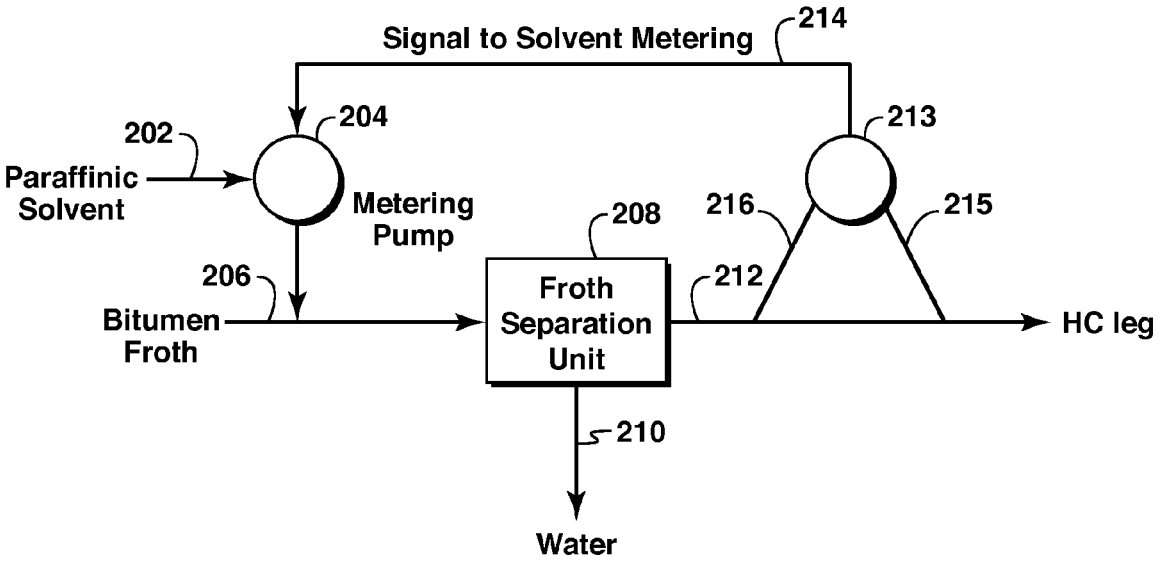
FIG. 2 is a flow diagram of a system for measuring the STBR according to a disclosed embodiment.

One way of practicing an embodiment of the present invention is illustrated in FIG. 2 in which a sulfur-free paraffinic solvent (202) (for example, pentane or hexane mixed with isomers of pentanes or hexanes) is metered and pumped through a metering pump (204) to the froth stream (206). The froth and the solvent are well mixed in an on-line static mixer (not shown in FIG. 2) before it enters the FSU (208). For the sake of simplicity, only one FSU vessel is shown in FIG. 2.

In the FSU (208), the water along with the asphaltenes and fines settle out at the bottom and are removed as the Water Leg (210) from the vessel. The diluted PFT bitumen (212) exits from the top of the vessel. An on-line X-Ray Fluorescence (XRF) unit (213) measures the sulfur in a portion of the Hydrocarbon Leg (216) and compares it with the target sulfur quantity, which corresponds to the target STBR. If the measured sulfur is higher than the target sulfur, indicating a ratio lower than the target STBR, the XRF sends a signal (214) to the metering pump to add more solvent. The portion (215) exiting the XRF unit (213) is also shown.

Measuring sulfur offers an opportunity to control solvent addition, as it is more sensitive to changes in solvent to bitumen ratio than density, the measurement of which is a conventional way of determining appropriate solvent addition.

Whereas "target" or "predetermined" values have been referred to herein, this is intended to include a range. By way of example, in a FSU feedback loop, an acceptable range of STBR or a range of native bitumen marker amount may be used to determine whether to add additional solvent to the process, or whether to adjust the solvent/bitumen additions.

As described below in Example 2, sulfur is ten times more sensitive than density over an expected range of solvent to bitumen ratio variation in PFT.

Figure 1:
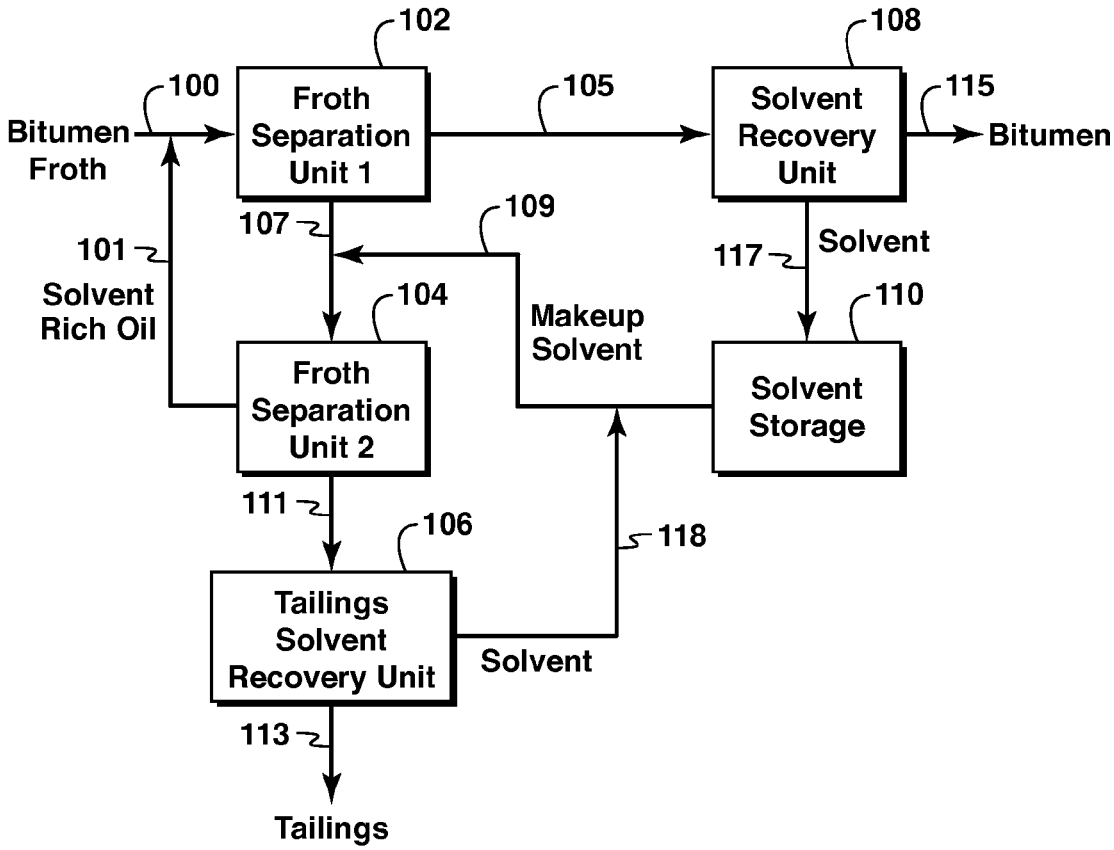
FIG. 1 (Prior Art)
FIG. 1 (Prior Art) is a flow diagram of a paraffinic froth treatment process.

For determining hydrocarbon and solvent loss in the tailings, an on-line XRF capable of measuring at least one native bitumen marker is placed on a slip stream taken from the well-mixed tailings (113) exiting the TSRU (106) (FIG. 1). The instrument may be calibrated and some matrix corrections may be required. Furthermore, the sulfur, nickel and vanadium (or other marker) in the inorganics (minerals) of the tailings, if any, should be accounted for.

EXAMPLES

Example 1

Controlling STBR by Measuring Sulfur

In this example, it is assumed that the target STBR is 2:1 (w/w) and the target PFT bitumen solvent blend sulfur corresponding to this ratio is 1.0 wt %.

During start-up of the plant, the XRF measures the PFT bitumen solvent blend sulfur to be 1.5 wt % which indicates that sulfur concentration is higher than the target sulfur concentration and that the STBR is less than the target ratio.

The controller is programmed to add additional solvent through the metering pump until the target solvent to bitumen ratio is achieved.

Example 2

Comparing the use of Native Markers versus Density for Measuring the STBR

This example compares an embodiment of the present invention using sulfur measurement with a conventional method using density measurement.

PFT bitumen (taken from the Kearl oil sands in Alberta) was mixed with condensate (solvent) (taken from a Cold Lake oil sands operation in Alberta) to achieve the target STBR of 1.60 (w/w). The density of the blend at the target STBR was calculated using a tuned density blending model. The sulfur concentration (wt %) in the blend was also calculated from the sulfur concentration in the bitumen, assuming the solvent had no sulfur.

To determine the sensitivity of the density and sulfur levels to the changes in the STBR, the latter was varied first from 1.54 to 1.66 (w/w) to represent an example of an acceptable variation during normal operation of the FSU. This variation led to a density difference of only ±0.28% from the density at the target solvent to bitumen ratio. By contrast, the sulfur varied by ±2.7% over the same solvent to bitumen ratio variation (see Table 1 below). This indicates that sulfur is about ten times more sensitive than density to changes in STBR.

To examine the sensitivity further, the solvent to bitumen ratios were varied between 1.41 and 1.82 to represent start-up solvent to bitumen ratios. Over this variation, the density changed by only ±1%, while the sulfur changed by ±10% from the corresponding values at the target STBR (Table 1).

TABLE 1

Sensitivity of Density and STBR at T: 25° C., Kearl PFT Bitumen, Cold Lake Condensate (solvent)

| STBR (w/w) | Density kg/m3 | % Difference from target | Sulfur wt % | % Difference from target |
|---|---|---|---|---|
| 1.60 (target) | 803.12 | 0.00 | 1.23 | 0.00 |
| 1.54 (low) | 805.11 | 0.25 | 1.26 | 2.29 |
| 1.66 (high) | 800.91 | −0.28 | 1.20 | −2.69 |
| 1.41 (lower) | 810.61 | 0.92 | 1.34 | 8.13 |
| 1.82 (higher) | 795.55 | −0.95 | 1.12 | −9.85 |

This example shows the advantage of using sulfur to better control solvent addition in the PFT.

U.S. Pat. No. 7,067,811 describes, according to the abstract: "A method [ . . . ] for providing rapid on-line analyses of chemical compositions such as chemical process streams, utilizing near-infrared (NIR) spectroscopy in combination with chemometrics. In the method, for each type of analysis to be conducted, a database is provided by analyzing a series of samples using standard laboratory analytical procedures, utilizing the results as reference values to establish quantitative calibration models from NIR spectroscopy using chemometric techniques and storing this information in a computer database. An NIR spectroscopic system is also provided comprising a transflectance or a transmittance probe coupled via fiber-optic cables to a stable white light source and a spectrograph. The probe is inserted into a test sample or chemical process stream to be analyzed, a stable white light of selected wavelength range is beamed to the probe and the spectra obtained on the spectrograph are recorded. Finally the spectra obtained are correlated to the reference data stored in the computer to obtain a rapid measurement of the analysis desired." In that patent, the NIR does not measure a native bitumen marker.

Canadian Patent No. 2,075,108 describes, according to the abstract: "A refractometer [ . . . ] used to monitor naphtha/bitumen ratio in diluted bitumen froth containing high water and solids contents. The addition of naphtha to the froth is controlled in response to the refractometer readings". In that patent, a native bitumen marker is not measured. As shown in Table 2, using a refractometer offers inferior sensitivity as compared with that offered by the use of native bitumen markers, as shown in Tables 1 (sulfur), 3 (vanadium) and 4 (nickle). The refractometer offers even inferior sensitivity compared to the conventional densitometer (Tables 1 and 2).

TABLE 2

Refractive Index (RI) Sensitivity
Bitumen RI: 1.569; Naphtha RI: 1.413

| STBR | RI | % Difference from Target |
|---|---|---|
| 1.60 (target) | 1.473 | 0 |
| 1.54 (low) | 1.474 | 0.10 |
| 1.66 (high) | 1.472 | −0.19 |
| 1.41 (lower) | 1.478 | 0.41 |
| 1.82 (higher) | 1.468 | −0.64 |

TABLE 3

Vanadium (V) Sensitivity
Bitumen V: 200 ppm; Naphtha V: 0 ppm

| STBR | V, ppm | % Difference |
|---|---|---|
| 1.60 (target) | 76.92 | 0 |
| 1.54 (low) | 78.74 | 2.36 |
| 1.66 (high) | 75.19 | −4.62 |
| 1.41 (lower) | 82.99 | 10.14 |
| 1.82 (higher) | 70.92 | −15.69 |

TABLE 4

Nickle (Ni) Sensitivity
Bitumen Ni: 100 ppm; Naphtha Ni: 0 ppm

| STBR | Ni, ppm | % Difference |
|---|---|---|
| 1.60 (target) | 38.46 | 0 |
| 1.54 (low) | 39.37 | 2.36 |
| 1.66 (high) | 37.59 | −4.62 |
| 1.41 (lower) | 41.49 | 10.14 |
| 1.82 (higher) | 35.46 | −15.69 |

In the preceding description, for purposes of explanation, numerous details are set forth in order to provide a thorough understanding of the embodiments of the invention. However, it will be apparent to one skilled in the art that these specific details are not required in order to practice the invention.

Embodiments of the invention can be represented as a software product stored in a machine-readable medium (also referred to as a computer-readable medium, a processor-readable medium, or a computer usable medium having a computer-readable program code embodied therein). The machine-readable medium can be any suitable tangible medium, including magnetic, optical, or electrical storage medium including a diskette, compact disk read only memory (CD-ROM), memory device (volatile or non-volatile), or similar storage mechanism. The machine-readable medium can contain various sets of instructions, code sequences, configuration information, or other data, which, when executed, cause a processor to perform steps in a method according to an embodiment of the invention. Those of ordinary skill in the art will appreciate that other instructions and operations necessary to implement the described invention can also be stored on the machine-readable medium. Software running from the machine-readable medium can interface with circuitry to perform the described tasks.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A method of controlling a bitumen to solvent ratio of a process stream during solvent-assisted bitumen extraction comprising:

measuring an amount of a native bitumen marker in the process stream, wherein the native bitumen marker is sulfur, nickel, vanadium, iron, copper, manganese, or chromium;

comparing this amount to a predetermined native bitumen marker reference value; and adjusting an amount of bitumen froth, or solvent, or both, to the solvent-assisted bitumen extraction, if necessary, based on the measured amount of native bitumen marker as compared to the native bitumen marker reference value, wherein the solvent-assisted bitumen extraction is a paraffinic froth treatment.

2. The method according to claim 1, wherein the measuring is effected using X-Ray Fluorescence.

3. The method according to claim 1, wherein the measuring is effected using Inductively Coupled Plasma (ICP) or Atomic Absorption (AA).

4. The method according to claim 1, wherein the process stream is a hydrocarbon leg from a froth separation unit of the solvent-assisted bitumen extraction.

5. A method of determining hydrocarbon loss during solvent-assisted bitumen extraction, comprising:

measuring an amount of a native bitumen marker in a tailings stream of the solvent-assisted bitumen extraction, wherein the native bitumen marker is sulfur, nickel, vanadium, iron, copper, manganese, or chromium, and wherein the solvent-assisted bitumen extraction is a paraffinic froth treatment; and converting this amount to hydrocarbon loss via the tailings stream using reference data.

6. The method according to claim 5, wherein the tailings stream is from a tailings solvent recovery unit of the solvent-assisted bitumen extraction.

7. The method according to claim 5, wherein X-Ray Fluorescence is used to measure the amount of native bitumen marker in the tailings stream for conversion to the hydrocarbon loss via the tailings stream based on reference data.

8. The method according to claim 5, wherein Inductively Coupled Plasma (ICP) or Atomic Absorption (AA) is used to measure the amount of native bitumen marker in the tailings stream for conversion to the hydrocarbon loss via the tailings stream based on reference data.

* * * * *